US010028877B2

(12) United States Patent
Hoijng

(10) Patent No.: US 10,028,877 B2
(45) Date of Patent: Jul. 24, 2018

(54) CONNECTION SYSTEM FOR AN INNER COFFIN AND AN OUTER COFFIN, A METHOD FOR COUPLING AN INNER COFFIN AND AN OUTER COFFIN AND A COMBINATION OF AN INNER COFFIN AND AN OUTER COFFIN

(71) Applicant: Rolandus Franciscus Beatrijs Marie Josef Hoijng, Vught (NL)

(72) Inventor: Rolandus Franciscus Beatrijs Marie Josef Hoijng, Vught (NL)

( * ) Notice: Subject to any disclaimer, the term of this patent is extended or adjusted under 35 U.S.C. 154(b) by 0 days.

(21) Appl. No.: 15/040,642

(22) Filed: Feb. 10, 2016

(65) Prior Publication Data

US 2016/0228318 A1 Aug. 11, 2016

(30) Foreign Application Priority Data

Feb. 10, 2015 (NL) ..... 2014269

(51) Int. Cl.
*A61G 17/00* (2006.01)
*A61G 17/04* (2006.01)
*A61G 17/02* (2006.01)

(52) U.S. Cl.
CPC ..... *A61G 17/001* (2017.05); *A61G 17/00* (2013.01); *A61G 17/02* (2013.01); *A61G 17/04* (2013.01); *A61G 17/041* (2016.11); *A61G 2203/76* (2013.01)

(58) Field of Classification Search
CPC .. A61G 17/00; A61G 17/04; A61G 2017/041; A61G 17/041; A61G 17/02; A61G 2203/76; A61G 17/001; E04H 13/00; Y10T 16/4701; Y10T 16/501
USPC ..... 16/424, 439; 27/2, 27, 35, 3; 211/85.16; 52/133
See application file for complete search history.

(56) References Cited

U.S. PATENT DOCUMENTS 906,363 A * 12/1908 Babbitt ..... B25G 1/04 16/429
3,654,676 A * 4/1972 McHugh ..... A61G 17/00 27/2
3,844,003 A * 10/1974 Angermann ..... A61G 17/04 16/439
5,481,785 A * 1/1996 Minton ..... A61G 17/00 27/19
5,548,880 A 8/1996 Harb
6,345,422 B1 * 2/2002 Darby ..... A61G 17/00 27/2
6,385,824 B1 5/2002 Schwartz
7,475,458 B1 1/2009 Gordon et al.
(Continued)

FOREIGN PATENT DOCUMENTS

CA 909488 9/1972
DE 4037645 5/1992
DE 9317175 2/1994

*Primary Examiner* — William Miller
(74) *Attorney, Agent, or Firm* — Peacock Law P.C.; Janeen Vilven; Camille Martinez

(57) ABSTRACT

A connection system for an inner coffin and an outer coffin, the inner coffin comprising a bottom and side walls extending from the bottom, wherein the outer coffin comprises a load bearing frame construction near the bottom of the inner coffin. The load bearing frame construction comprises movable support pins embodied for insertion in openings that are provided in an inner coffin's wall near the bottom thereof, for carrying the inner coffin.

10 Claims, 8 Drawing Sheets

(56) References Cited

U.S. PATENT DOCUMENTS

| | | | | |
|---|---|---|---|---|
| 8,112,851 | B1 * | 2/2012 | Hughes | A61G 17/04 16/429 |
| 2013/0174378 | A1 * | 7/2013 | Davis | A61G 19/00 16/429 |

* cited by examiner

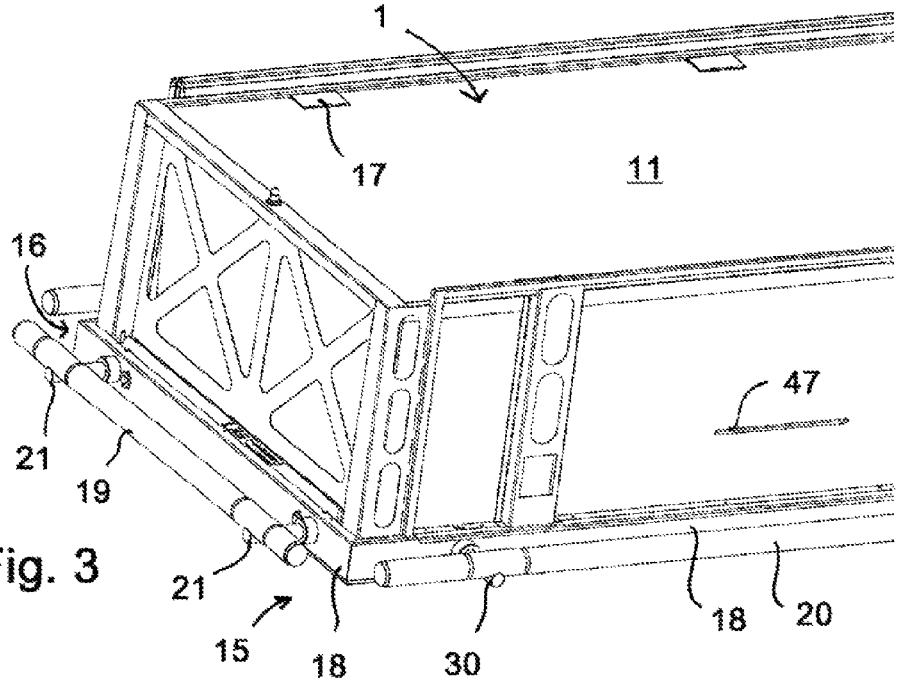
Fig. 3
Fig. 4
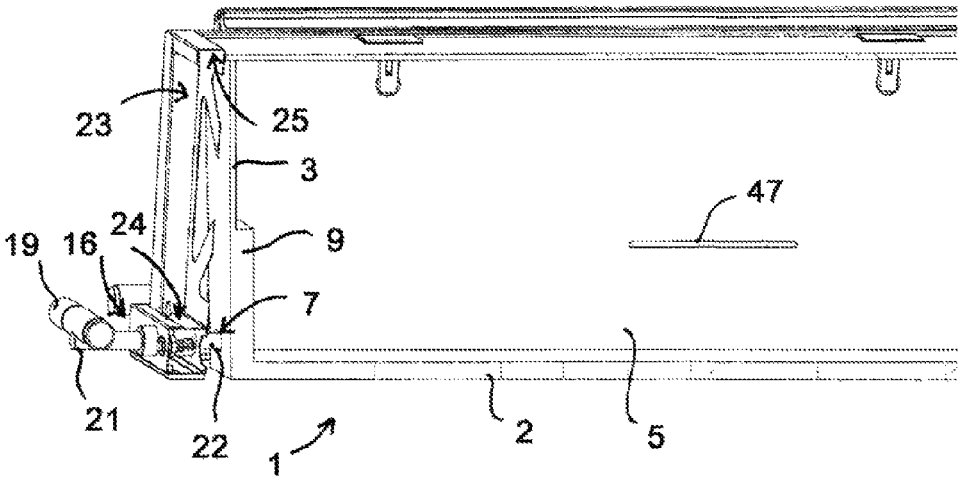

CONNECTION SYSTEM FOR AN INNER COFFIN AND AN OUTER COFFIN, A METHOD FOR COUPLING AN INNER COFFIN AND AN OUTER COFFIN AND A COMBINATION OF AN INNER COFFIN AND AN OUTER COFFIN

CROSS-REFERENCE TO RELATED APPLICATIONS

This application claims priority to and the benefit of the filing of Netherlands Patent Application No. 2 014 269, filed on Feb. 10, 2016, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

Field of the Invention (Technical Field)

The present invention relates to a connection system for an inner coffin and an outer coffin. The invention also relates to a method for coupling an inner coffin and an outer coffin. Furthermore, the invention relates to a combination of an inner coffin and an outer coffin.

Description of Related Art

The connection system of the invention is especially directed towards the use with a coffin, wherein an inner coffin comprising a corpse is received within an outer coffin, said outer coffin determining the appearance of the coffin. Such a configuration of a coffin allows one to repeatedly use the outer coffin whereas the inner coffin, together with said corpse, will be cremated or buried. It is clear that the inner coffin and outer coffin must be mutually coupled for allowing transport of said corpse within said outer coffin.

Such a system is known in the art. An outer coffin comprising a load bearing frame construction near the bottom of the inner coffin is, for example, described in Dutch patent application NL 2 010 192, the outer coffin comprising a bottom carrying the inner coffin. This known construction has the disadvantage that the inner coffin must be removed from the outer coffin through a cumbersome construction.

Therefore, there is need for a simplified connection system for coupling an inner coffin to an outer coffin, wherein separation of same is simplified.

BRIEF SUMMARY OF THE INVENTION

The invention therefore aims at providing an improved connection system as mentioned in the preamble.

The invention especially aims at providing a connection system as mentioned in the preamble providing a fast coupling and decoupling.

The invention also aims at providing an improved connection system wherein the outer coffin can be removed from the inner coffin in a simple way.

The invention also aims at providing a connection system that provides a secure coupling between the inner coffin and the outer coffin such that the inner coffin can be simply transported together with the outer coffin.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIG. 3 is a detailed view of a cut away outer coffin and inner coffin according to the invention;

FIG. 4 is a cut away detailed view of an outer coffin and inner coffin according to the invention;

DETAILED DESCRIPTION OF THE INVENTION

Figure 1:
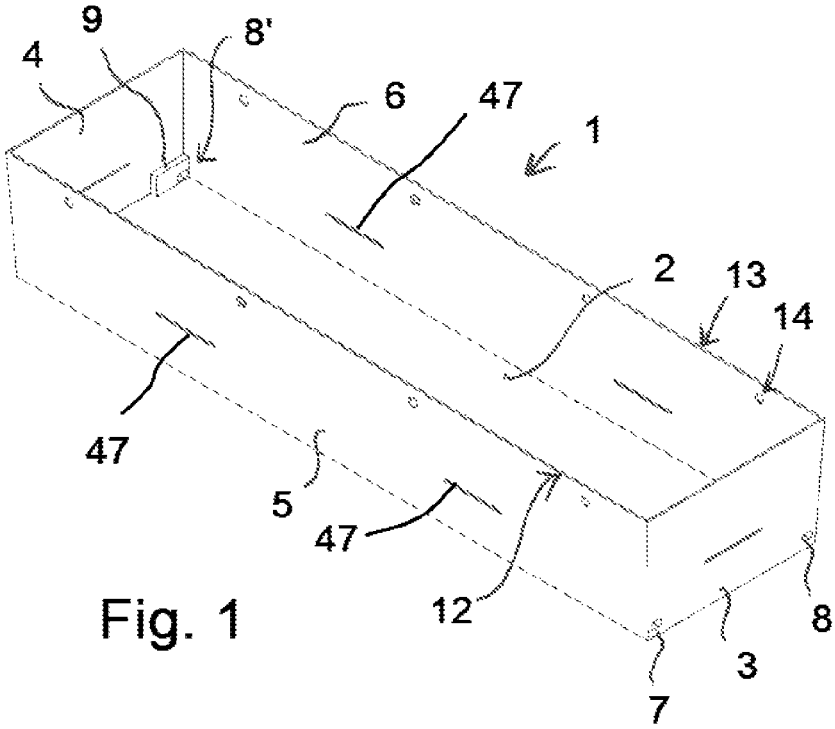
FIG. 1 shows an open inner coffin for use in the present invention.

So as to obtain at least one of the above mentioned advantages, according to a first embodiment the invention provides a connection system comprising the features of claim 1. This connection system has the advantage that a very easy and simple connection system is obtained. The coupling between inner coffin and outer coffin is very secure and easy and can be decoupled very easy as well. However, the inner coffin can be easily transported together with the outer coffin.

In the connection system according to the invention, it is especially preferred that the openings in walls of the inner coffin are comprised of recesses for at least partially receiving a support pin. As a consequence, the support pin can be simply fed into the inner coffin, yielding a very secure coupling.

It is furthermore preferred that the wall of the inner coffin is reinforced near an opening with respect to the other wall parts. Such yields a wall that is reinforced sufficiently near the opening for carrying the inner coffin by means of the support pins, whereas the other parts of the wall have a (relatively reduced) strength that however is sufficient for carrying the corpse.

According to an alternative embodiment, the opening in the wall of the inner coffin is embodied as a non-continuous recess for receiving a support pin at least partly. This has the advantage that each support pin may be fed into the end of each respective recess. Such allows one to accurately aligning the inner coffin in the outer coffin by displacing every support pin along the same distance. Also, the inside of the coffin remains sealed with respect to the surroundings.

Therefore, preference is given to a connection system wherein the support pins are displaceable between a first position at a distance from the inner coffin and a second position at least partly received in an opening of the inner coffin.

It is especially preferred for the frame construction to be embodied for securing the support pins in a first or a second position thereof. Particularly, securing the support pins in a second position provides the advantage that the support pins cannot be removed from the openings of the inner coffin unintentionally. Said securing therefore preferably is adjustable as desired. It is especially preferred for the support pins to be securable both in the first and in the second position, such that both the carrying position and the non-carrying position, for positioning the outer coffin over the inner coffin, are secured.

The wall's reinforcement preferably is comprised of an additional wall material provided along the opening. For example, this may be the same material as where the wall is made off, for example MDF or the like. Therefore, the wall may have a thickness that is twice the thickness of other parts of the wall if a single layer of wall material is added around the opening, or three times said thickness if a double layer of wall material is added to the wall around these openings. Even a threefold layer of wall material may be added to the wall. The coffin's walls may for example be manufactured from MDF in a thickness of 6 mm, wherein a threefold layer of MDF is added to the wall near each opening, such that a total wall thickness of 24 mm is obtained. Of course, every other material that has a sufficient strength and that is suitable for the intended use of the coffin may be added to the wall.

It is especially preferred that the load bearing frame construction is embodied as a substantially oblong, rectangular or trapezoidal-shaped body and comprises support pins at at least two opposite sides. Such yields a stable positioning of the inner coffin in the outer coffin. Most preferably, the shape of the bottom of the inner coffin follows the outer coffin's shape, especially at the sides comprising the openings and the cooperating support pins, respectively.

An aesthetically attractive coupling is obtained when the outer coffin surrounds the inner coffin at its circumferential sides and at its upper side. Such may be important when the inner coffin has a raw appearance and when the reusable outer coffin only has a beautiful and attractive appearance. Additionally, such allows one to easily remove the outer coffin from the inner coffin, after removing the support pins from the openings, for preparing the inner coffin for a cremation or the like.

A use of the invention for a coffin is especially suitable if the inner coffin is comprised of a bottom, side walls and optionally a removable lid covering said side walls at a top side thereof, and wherein the outer coffin comprises side walls and a top side.

So as to be able to easily transport the outer coffin both alone and in combination with the inner coffin, it is preferred that the outer coffin comprises carrying handles that are connected to the frame construction for carrying the outer coffin by persons. Such carrying handles will be provided at the longitudinal sides of the outer coffin. Preferably, these carrying handles are displaceable (for example slidable, telescoping or tiltable) between a position close to the outer coffin and a position relatively further away from the outer coffin. As a consequence, the outer coffin can be easily transported through small passageways.

The carrying handles are preferably connected to the frame construction by means of connection means. More in particular, it is preferred for the support pins to be embodied with said connection means, yielding a simple, practical and optically attractive embodiment.

The invention allows one to have a limited number of outer coffins in stock. On the contrary, a large number of inner coffins can be kept in stock, since all inner coffins are substantially identical. In order to limit the required storage space it is preferred that the inner coffin comprises walls that widen conically from the bottom, such that inner coffins can be stacked in an at least partially nested manner. This allows one to store stacks of multiple inner coffins.

According to a further aspect the invention relates to a method for coupling an inner coffin and an outer coffin, comprising the steps of: providing an inner coffin with openings in sides thereof, positioning an outer coffin over the inner coffin, said outer coffin comprising a frame construction with support pins that can be displaced between two positions, said support pins being provided at a first position that is relatively away from the inner coffin, aligning the support pins of the outer coffin with the openings of the inner coffin, and placing the support pins from the first position into a second position, wherein the support pins are received at least partly inside the openings of the inner coffin, for carrying the inner coffin by the outer coffin. This method provides the advantages and effects that are obtained with the connection system described above.

In the method according to the invention, it is also preferred that both the inner coffin and the outer coffin have a substantially oblong, rectangular or trapezoidal-shaped bottom.

A stable coupling is obtained when the support pins at the outer coffin and the cooperating openings in the inner coffin are provided at opposite sides. For example, the may be provided at the end sides (that are shorter than the longitudinal sides), preferably near corner positions of the short to the long sides (of the end sides to the longitudinal sides). However, an effective embodiment is obtained when the support pins and openings are provided at the longitudinal sides.

So as to be able to easily and efficiently transport the inner coffin and outer coffin after coupling same, it is preferred that the outer coffin comprises carrying handles that are connected to the frame construction for carrying the outer coffin by persons. As a further advantage, the outer coffin can be easily transported and removed from the inner coffin or placed over it.

An aesthetically attractive and technical simple coupling is obtained, as well as a secure way of transporting same, when the carrying handles are connected to the frame construction by means of connection means and wherein the support pins are embodied with the connection means.

According to a still further aspect the invention relates to a combination of an inner coffin and an outer coffin with a connection system for mutually coupling the inner coffin and the outer coffin according to claim 1, comprised of a recess in the inner coffin and a displaceable pin in the outer coffin.

Said combination is preferably embodied such that the outer coffin comprises carrying handles that are positioned at a distance from a side thereof and wherein a receiving means is provided at said side, further comprising a platform with a bracket that is embodied for releasable cooperation with said receiving means, such that a stable coupling of said platform to said outer coffin is obtained when mutually coupling said receiving means and said bracket and carrying said platform on said carrying handle.

More preferably, in the combination as mentioned above, the receiving means has a recess directing towards a bottom of said inner coffin and wherein said bracket has a protrusion directing away from said bottom when in use, said bracket being embodied for receiving said protrusion in the recess of said receiving means.

In the figures, the same and analogous parts are denoted by the same reference numbers. However, not all parts that are required for a practical embodiment are shown in the drawing, for ease of reference and understanding the drawing.

FIG. 1 shows an inner coffin 1 for use in the resent invention. The inner coffin 1 comprises a bottom 2 and side walls 3, 4, 5, 6 that extend from the bottom 2. The walls widen from the bottom 2 to some extent, such that a plurality of inner coffins 1 can be stacked in a nested manner.

The inner coffin 1 has an oblong shape with two relatively short sides 3, 4 (end sides) and two relatively long sides 5, 6 (longitudinal sides). At the short side 3 openings 7, 8 are provided near the bottom 2. In short side 4 openings are provided as well (not visible in this FIG. 1). As shown in FIG. 1, reinforcement 9 is provided at short side 4 around an opening provided in said short side. The reinforcement 9 is also provided with an opening 8' aligned with the opening in short side 4. Reinforcements are also provided near the openings in short side 4, among which openings 7', 8'.

Figure 2:
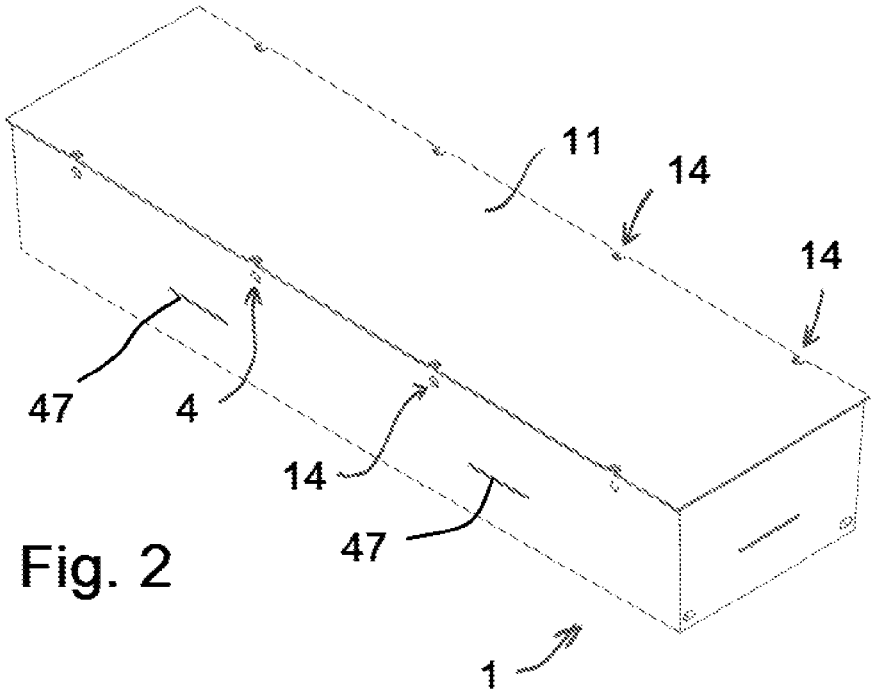
FIG. 2 shows a closed inner coffin for use in the present invention.
Figure 11:
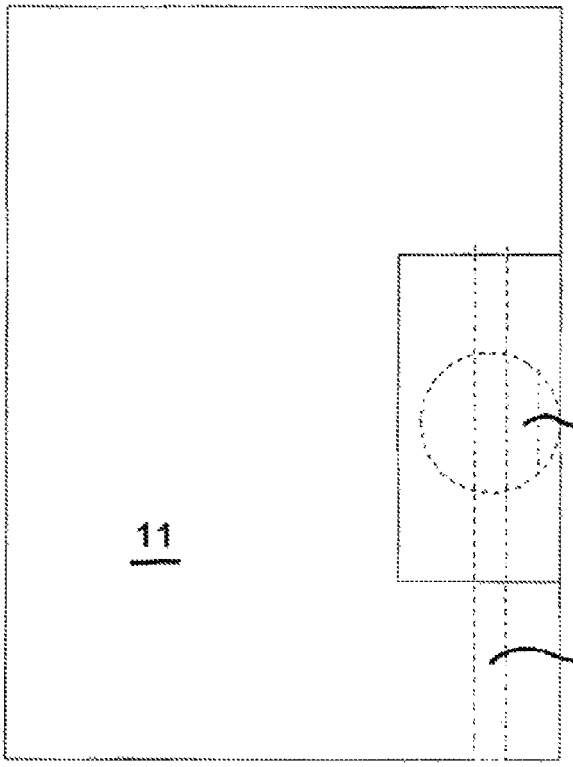
FIGS. 11, 12 and 13 show a closure system for connecting a lid onto the inner coffin.
Figure 12:
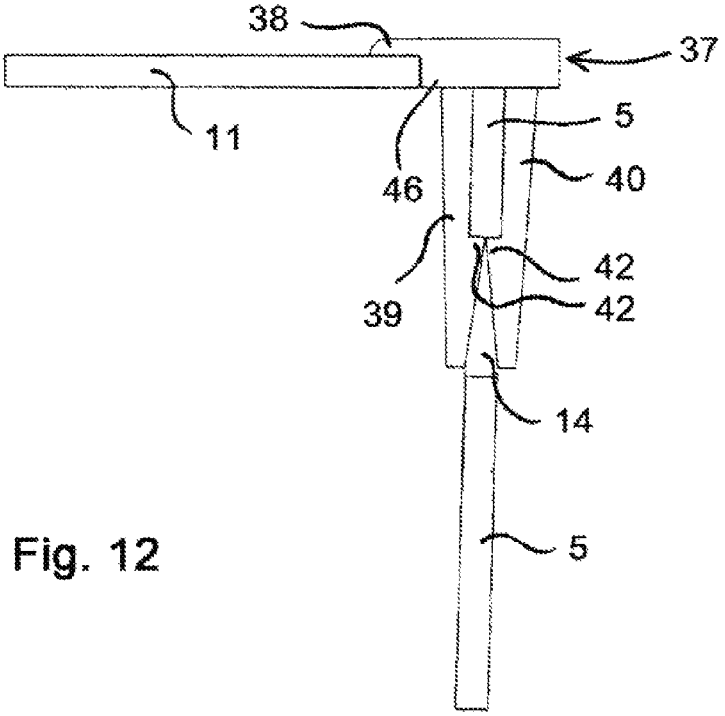
Figure 13:
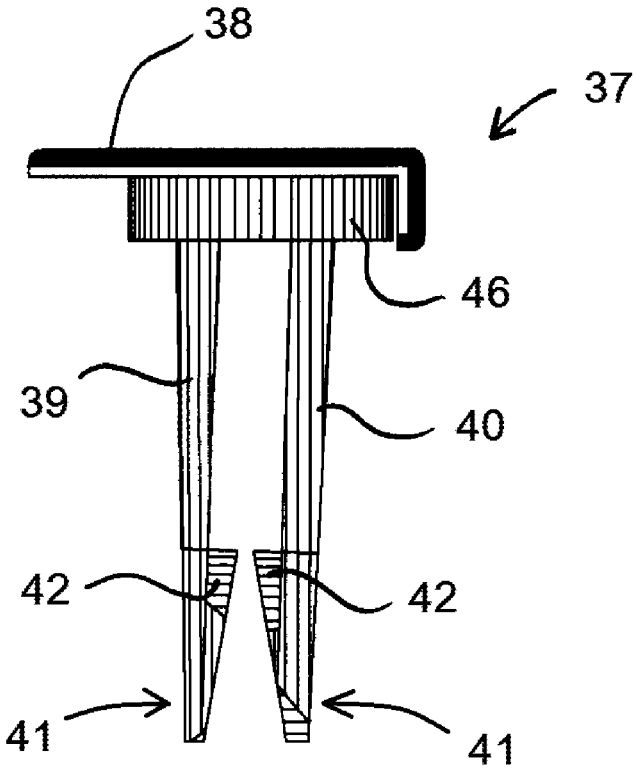

The inner coffin 1 is embodied for carrying a corpse. It is common practice to provide a lid 11 for closing off inner coffin 1, as depicted in FIG. 2. Said closing may be obtained by means of a closing system 17 (as depicted in FIG. 3) being carried by lid 11 and, being fed through a hole 36 in lid 11, engaging around a wall 5, 6 with two legs from a top edge 12, 13 of said wall 5, 6. A leg of said closing system may comprise a protrusion engaging an opening or recess 14 in said wall 5, 6, such that a sufficient closure of the inner coffin 1 is obtained. The FIGS. 11-13 provide a more accurate representation of a preferred embodiment of a closing system 17, more in particular embodied as a clip 37.

FIG. 3 shows a detailed view of a cut away outer coffin 15 being provided with an inner coffin 1 which is closed off by means of a lid 11, according to the invention. In the embodiment shown, the outer coffin 15 comprises a frame construction 16 that fully encloses the circumference of inner coffin 1. In this embodiment, the frame construction 16 comprises a beam 18 that is positioned, in the state of use, near the bottom 2 of the inner coffin 1. The term "state of use" relates to the state or condition when the inner coffin 1 is connected to the outer coffin 15. The outer coffin 15 comprises carrying handles 19 at its short sides 3, 4 and carrying handles 20 at its long sides 5, 6. These carrying handles extend at all sides of outer coffin 15. The carrying handles 19, 20 are connected to frame construction 16, 18 by means of connection means 21, 22.

The connection means 21 also comprise support pins that can be fed into openings 7, 8 of short side 3 and openings 7', 8' of short side 4 of the inner coffin 1 for providing a coupling between inner coffin 1 and outer coffin 15. The support pins may be displaced from a first position distant from inner coffin 1 and a second position inside an opening 7, 8 of inner coffin 1.

In FIG. 4 a detailed view of a support pin 22 is provided. The support pin 22 forms a rigid assembly with carrying handle 19 and, as a consequence, the carrying handle 19 can be displaced as a whole away from inner coffin 1. In the support pin 22 recesses may be provided for receiving a locking pin (not shown) that is connected to the frame construction for locking (i.e. securing) the support pin in at least one of said first and second position.

Figure 8:
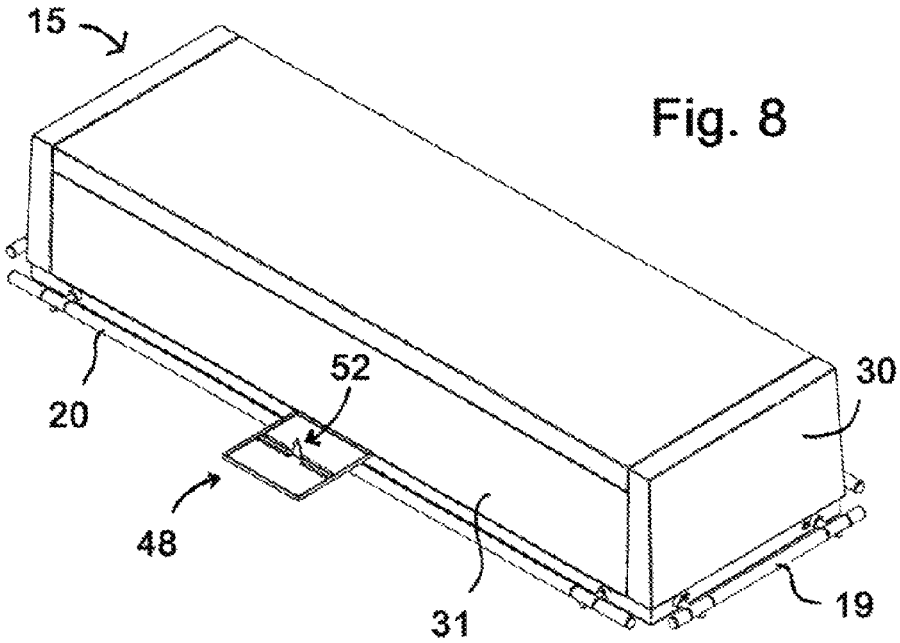
FIG. 8 is a perspective view of a finished outer coffin according to the invention.

The frame construction 16 comprises frame parts 18 that ex-tend horizontally (in the state of use) along sides 3, 4, 5, 6 of inner coffin 1 as well as vertically extending frame parts 23. These frame parts are mutually connected so as to obtain a stable frame construction 16. The frame construction may be embodied for receiving replaceable panels (not shown in FIG. 4). As a consequence, the appearance of outer coffin 15 may be easily adapted, by replacing the panels. For example, decorative panels 30, 31 may be coupled to or hung from frame construction 16, as schematically shown in FIG. 8.

Figure 5:
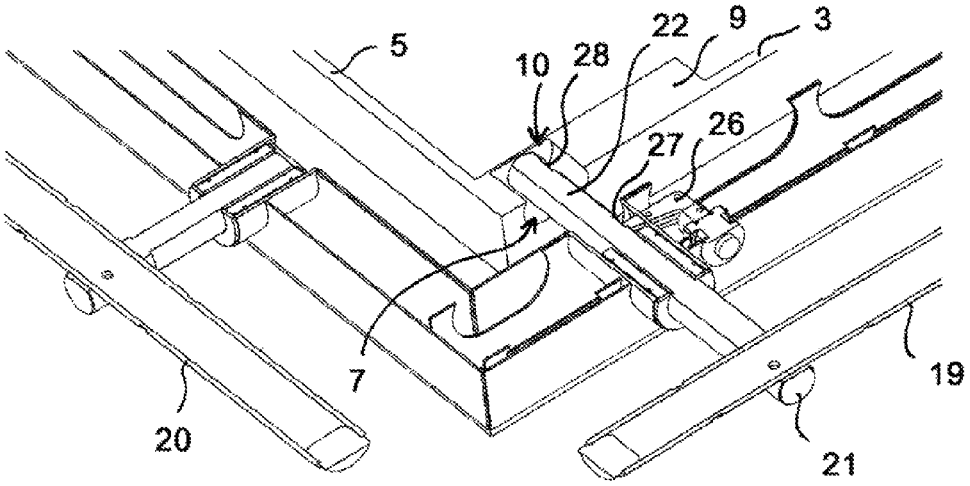
FIG. 5 is a cut away detailed view of an outer coffin and inner coffin according to the invention.

FIG. 5 shows a further detailed view of a coupling mechanism with the support pin 22, said support pin being received in opening 7 of side wall 3 and opening 8' of reinforcement 9.

Said coupling mechanism further comprises a locking pin 26 for positioning inside recess 27, 28 of support pin 22 for pre-venting a displacement thereof. In the embodiment shown, the locking pin 26 is embodied for moving in or out of recess 7, 8.

Figure 6:
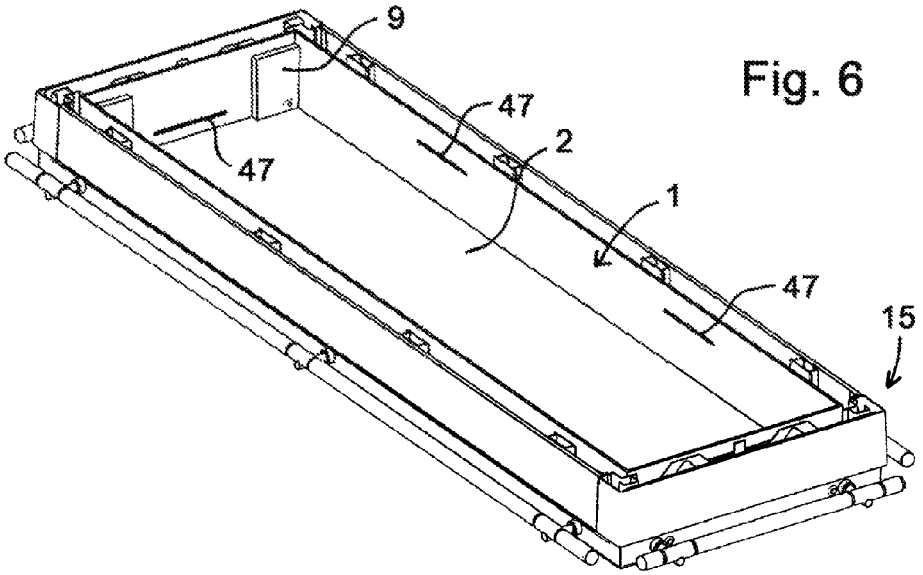
FIG. 6 is a cut away view of an outer coffin and inner coffin according to the invention.

FIG. 6 shows a partially cut away view of an outer coffin 15 and inner coffin 1 according to the invention. The centralized positioning of the inner coffin 1 within the outer coffin 15 is clearly shown. As a matter of fact, the outer coffin 15 actually does not have the shape of a box, since same comprises no bottom.

Figure 7:
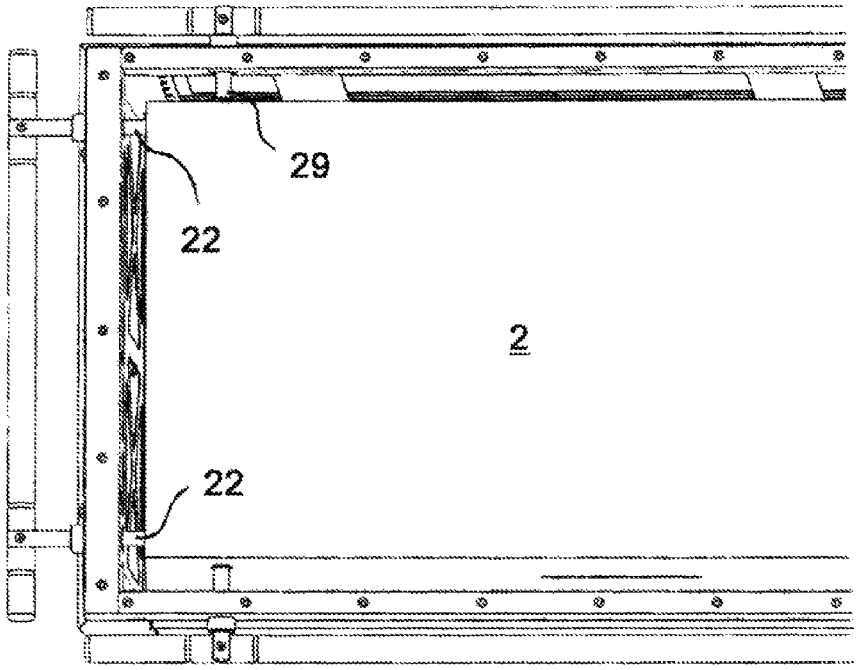
FIG. 7 is a view from below of an outer coffin and inner coffin according to the invention.

FIG. 7 shows a view from below of outer coffin 15 and inner coffin 1. The support pins, comprising a visible part 21 outside said construction and a part 22 inside said construction, are placed in a coupled state with said inner coffin 1. In this description, the support pins are randomly denoted with a single reference number 21 or 22, unless an exact positioning is required for a correct description. The inner coffin 1 may therefore be carried by carrying the outer coffin 15. At the long sides the pins 29 are shown, being connection means 22 of said carrying handle that are displaced inwardly. By displacing the carrying handles 20 inwardly, which means that they are displaced in the direction of the outer coffin or even against the outer coffin, said coffin may be transported more easily through narrow passageways.

The outer coffin 15 is aligned with respect to the inner coffin 1 by means of the outer shape of said inner coffin 1, more in particular the top side of the inner coffin 1 due to the tapered shape thereof, such that the support pins 21 are aligned with the openings 7, 8 in the inner coffin 1. Only part of the frame construction 16 is shown in this figure.

FIG. 8 shows a perspective view of an outer coffin 15 comprising panels 30, 31. Said panel 30 is an end-cover for the outer coffin whereas panels 31 are replaceable panels that can be attached to the wall elements 23 of frame construction 16, 18. Such allows one to change the outer appearance of outer coffin.

Figure 14:
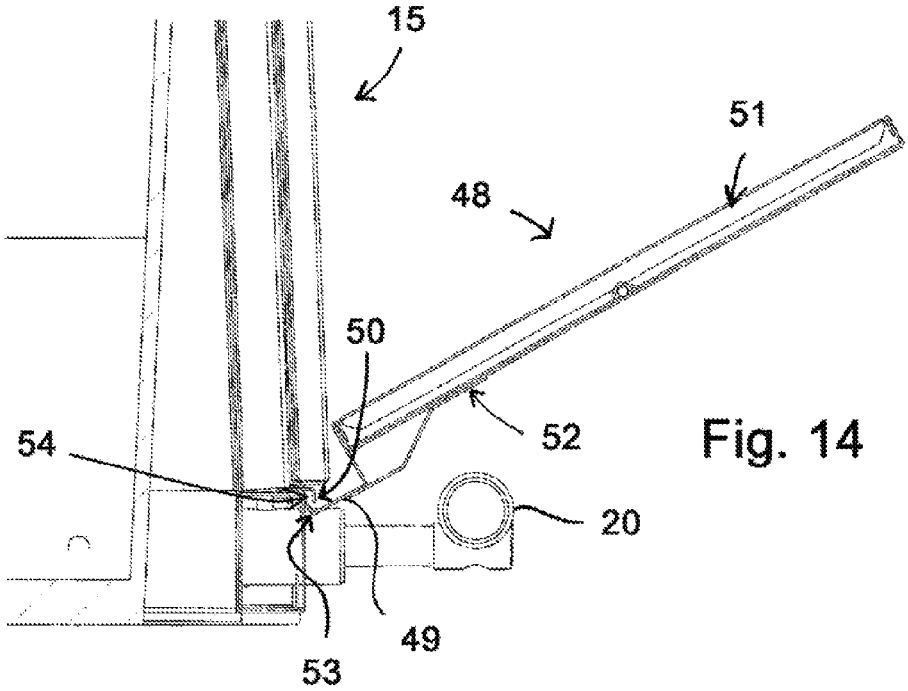
FIGS. 14 and 15 show a platform for use with the outer coffin.
Figure 15:
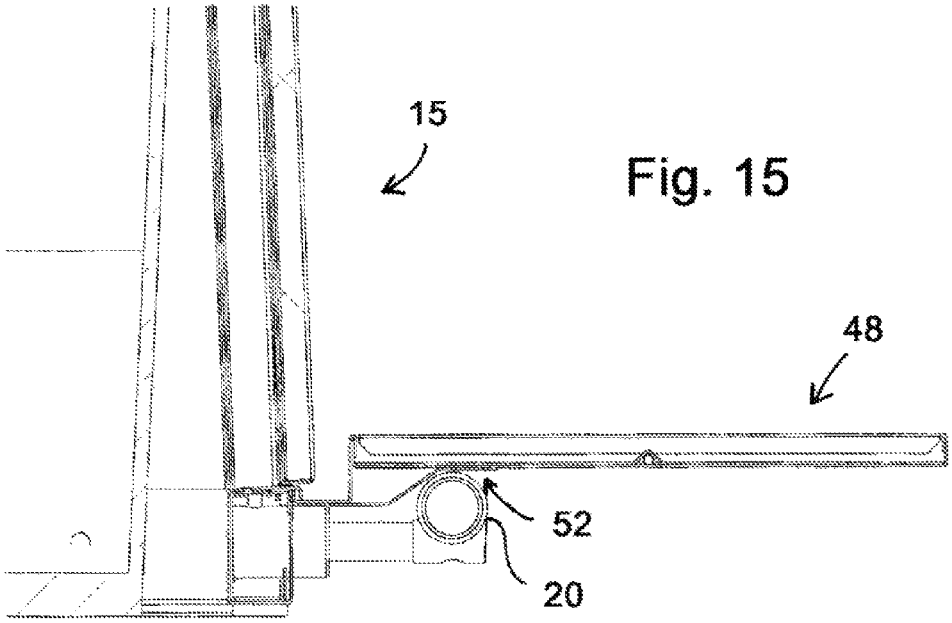

An advantageous embodiment is obtained by a platform 48 that can be attached removably to the coffin 15 according to the invention. For example, flowers, pictures or the like may be placed hereon at a funeral service. Personalization of the coffin 15 according to the invention is highly improved. FIG. 14 and FIG. 15 relate to a sectional view of the platform 48 to be coupled to outer coffin 15.

Figure 10:
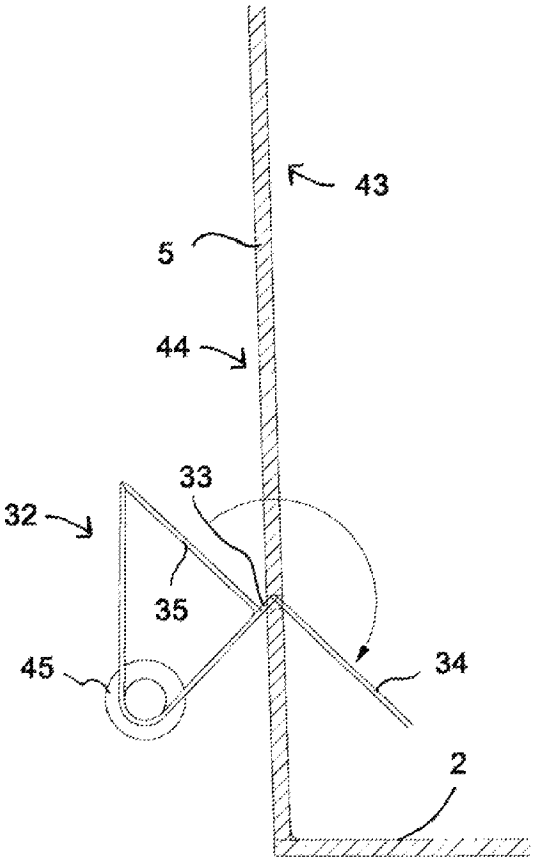
FIGS. 9 and 10 show a carrying means for carrying the inner coffin.
Figure 9:
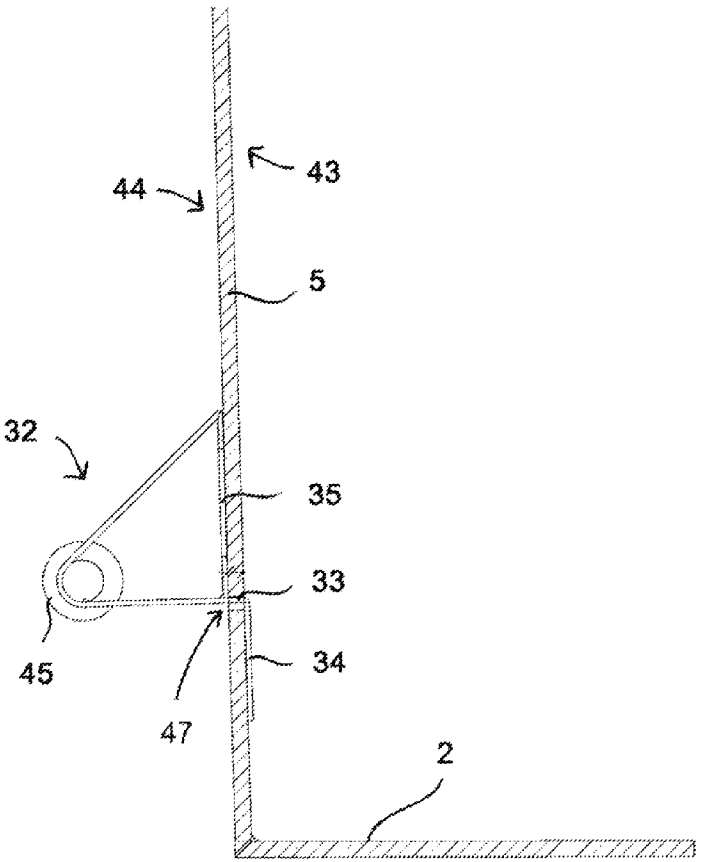

An easy handling of inner coffin 1 is obtained by providing said inner coffin 1 with hand grips 32, as shown in FIGS. 9 and 10. Opposite sides 3, 4, 5, 6 are provided with slot-like openings 47, as shown in FIG. 1, in which said hand grips 32 may be inserted. Hand grips 32 are provided with a central body 33, wherein a first body part 34 extends from said central body 33 in a first plane relative to the central body 33 into a first direction and wherein a second body part 35 extends in a second plane relative to the central body 33 and in an opposite direction, wherein said first and second planes are positioned parallel and at a mutual distance. They have a mutual distance that is substantial identical to the thickness of the walls 3, 4, 5, 6 of the inner coffin 1. Said first body part 34 is embodied to be inserted through said slot-like opening 47 from the outside of the inner coffin 1, such that the central body 33 is positioned in said opening 47, as shown in FIG. 10. Said first body part 34 is positioned ate the inside 43 against wall 3, 4, 5, 6 of the inner coffin 1 whereas said second body part 35 is positioned at the outside 44 against wall 3, 4, 5, 6 of the inner coffin 1. The gripping part 45 of hand grip 32 is positioned at a distance from the outside 44 of wall 5, 6. As a consequence, the inner coffin 1 can be easily handled, especially carried, by lifting said inner coffin 1 by said hand grips 32, when the hand grips 32 are inserted in the slot-like openings 47. Also, the hand grips 32 can be easily removed from the coffin 1, for example when the outer coffin 15 is positioned around the inner coffin 1 or when the inner coffin 1 is to be cremated.

It is especially preferred that the first body part 34 is positioned relatively closer to the bottom 2 of the inner coffin 1 than the second body part 35, as shown in FIG. 9.

So as to obtain a quick and secure closing of lid 11 on the inner coffin 1, the closing action of the inner coffin 1, comprising a bottom 2 and walls 3, 4, 5, 6, by means of a lid 11 may be performed as follows: the lid 11 comprises a through hole 36 that is substantially aligned with a wall 3, 4, 5, 6 of coffin 1, as shown in FIGS. 11, 12 and 13. Said through hole 36 preferably extends at both sides (the inside 43 and the outside 44) of a wall 5, 6. Said wall (in FIGS. 1 and 2 only the longitudinal walls 5, 6) comprise a recess or an opening 14 at a distance from the top edge 12, 13, said lid 11 bearing on said top edge 12, 13, said recess or opening 14 being aligned with said hole 36 in lid 11. A closing system 17 embodied as a clip 37 is used for coupling lid 11 to the wall 5, 6 of the inner coffin 1, as depicted in FIGS. 11 and 12. To that end, said clip 37 comprises a body 38 that is larger than hole 36 in lid 11, such that said clip will be supported with its body 38 on said lid 11, as well as two legs 39, 40 extending from said body 38. At least one of said legs 39, 40 comprise a shoulder 42 at its end 41. Clip 37 is put through said hole 36 in lid 11. The legs 39, 40 of clip 37 are positioned at the sides of the wall 5, 6 of the inner coffin 1, wherein said legs move away from each other and such that the at least one shoulder 42 is guided into the recess or opening 14 in wall 5, 6 when the at least one shoulder reaches said opening 14, since the legs 39, 40 than move back in the direction of one another. This ensures a secure coupling of the lid 11 and the inner coffin 1.

The clip 37 may comprise a thickening 46 at its body 38 that fits in the through hole 36, as shown among others in FIG. 13.

FIG. 14 shows a platform 48. On this platform 48 flowers or a picture may be placed. Said platform 48 bears with its bottom side on the carrying handle 20 and snaps with a bracket 49 in a hook 50, which is provided near the outer coffin's bottom side. As a result, a shelf surface 51 of platform 48 is in a horizontal position during use of the coffin. Such provides a stable support of, for example, flowers or a picture. The bracket 49 of platform 48 may be positioned between the carrying handle 20 and the side wall of the outer coffin and subsequently a protrusion 53 may be coupled into a receiving part 54 of said hook 50 (FIG. 14). Then, the bottom side 52 of platform 48 may be placed on the carrying handle 20 obtaining solid and stable positioning.

A particular embodiment of platform 48 is obtained when it comprises a dish-like and water tight shelf surface 51 and furthermore a pin 52 extending from said surface 51 (depicted in FIG. 8). As a result, for example, a block of foam (generally known under the designation "oase") intended for stabbing flowers and the like therein, may be fixedly placed on said platform. The flowers then may be positioned closely and intimately to the outer coffin. The water tight shelf surface allows for a drip-free 51 carrying of said flowers.

The invention is not limited to the embodiments mentioned above and as depicted in the figures. The invention is limited only by the appending claims.

The invention also relates to all combinations of features and method steps that are mentioned above independently from each other.

What is claimed is:

1. A connection system for an inner coffin and an outer coffin, said inner coffin comprising a bottom and side walls extending from the bottom thereby defining an interior for receiving a deceased, wherein said outer coffin comprises a load bearing frame construction near the bottom of the inner coffin, wherein the load bearing frame construction receives movable support pins embodied for insertion in openings that are provided in the inner coffin's side walls near the bottom thereof, wherein the outer coffin comprises carrying handles that are connected to the frame construction for carrying the outer coffin by persons, and wherein the carrying handles are connected to the frame construction by connection means which comprises the support pins thereby enabling carrying the inner coffin by the outer coffin.

2. The connection system according to claim 1, wherein the openings in the side walls of the inner coffin are each embodied as a non-continuous recess for receiving the respective support pin at least partly.

3. The connection system according to claim 1, wherein the load bearing frame construction is embodied as a substantially oblong, rectangular or trapezoidal-shaped body and receives the support pins at at least two opposite sides thereof.

4. The connection system according to claim 1, wherein the outer coffin surrounds the inner coffin.

5. The connection system according to claim 1, wherein the inner coffin additionally comprises a removable lid covering said side walls at a top side thereof, and wherein the outer coffin comprises side walls and a top side.

6. The connection system according to claim 1, wherein the support pins are displaceable between a first position at a distance from the inner coffin and a second position at least partly received in the respective opening of the inner coffin, and wherein the frame construction is embodied for securing the support pins in the first or the second position thereof.

7. The connection system according to claim 1, wherein the inner coffin side walls widen conically from the bottom, such that a plurality of inner coffins can be stacked in an at least partially nested manner.

8. A method for coupling an inner coffin and an outer coffin, the method comprising the steps of:

providing the inner coffin with openings in sides thereof, the inner coffin defining an interior for receiving a deceased, positioning the outer coffin over the inner coffin, said outer coffin comprising a frame construction with support pins that are displaced between two positions, said support pins being provided at a first position that is relatively distant from the inner coffin, aligning the support pins of the outer coffin with the openings of the inner coffin, and placing the support pins from the first position into a second position, wherein the support pins are received at least partly inside the openings of the inner coffin, wherein the outer coffin comprises carrying handles that are connected to the frame construction for carrying the outer coffin by persons, and wherein the carrying handles are connected to the frame construction by connection means which comprises the support pins thereby enabling carrying the inner coffin by the outer coffin.

9. A combination of an inner coffin and an outer coffin with a connection system for mutually coupling the inner coffin and the outer coffin, said inner coffin comprising a bottom and side walls extending from the bottom thereby defining an interior for receiving a deceased, wherein said outer coffin comprises a load bearing frame construction near the bottom of the inner coffin, wherein the load bearing frame construction receives movable support pins embodied for insertion in openings that are provided in the inner coffin's side walls near the bottom thereof, said openings comprised of a recess in the inner coffin and wherein the outer coffin comprises carrying handles that are positioned at a distance from a side thereof and wherein a receiving means is provided at said side, further comprising a platform with a bracket that is embodied for releasable cooperation with said receiving means, such that a stable coupling of said platform to said outer coffin is obtained when mutually coupling said receiving means and said bracket and carrying said platform via said carrying handles.

10. The combination according to claim 9, wherein the receiving means has a second recess directed towards said bottom of said inner coffin and wherein said bracket has a protrusion directing away from said bottom when in use, said bracket being embodied for receiving said protrusion in the second recess of said receiving means.

* * * * *